US005097715A

United States Patent [19]

Isozumi

[11] Patent Number: 5,097,715

[45] Date of Patent: Mar. 24, 1992

[54] ENGINE STARTER

[75] Inventor: Shuzou Isozumi, Himeji, Japan

[73] Assignee: Mitsubishi Denki K.K., Tokyo, Japan

[21] Appl. No.: 750,731

[22] Filed: Aug. 21, 1991

Related U.S. Application Data

[63] Continuation of Ser. No. 488,830, Mar. 6, 1990, abandoned.

[30] Foreign Application Priority Data

Mar. 6, 1989 [JP] Japan ..... 1-54406

[51] Int. Cl.[5] ..... F02N 11/00

[52] U.S. Cl. ..... 74/7 E; 74/6; 74/7 R

[58] Field of Search ..... 74/6, 7 R, 7 E; 123/179 M; 290/48

[56] References Cited

U.S. PATENT DOCUMENTS

| | | | |
|---|---|---|---|
| 4,707,616 | 11/1987 | Ogli et al. | 74/6 X |
| 4,760,274 | 7/1988 | Isozumi | 290/48 |
| 4,816,712 | 3/1989 | Tanaka | 310/237 |
| 4,838,100 | 6/1989 | Tanaka | 74/7 A |
| 4,862,027 | 8/1989 | Isozumi et al. | 74/6 X |
| 5,035,151 | 7/1991 | Isozumi | 74/7 A |
| 5,036,213 | 7/1991 | Isozumi | 74/6 X |

FOREIGN PATENT DOCUMENTS

| | | | |
|---|---|---|---|
| 1311876 | 11/1962 | France . | |
| 54-50738 | 4/1979 | Japan | 290/48 |
| 55-134753 | 10/1980 | Japan | 74/7 R |
| 56-34957 | 4/1981 | Japan | 290/48 |
| 56-47658 | 4/1981 | Japan | 290/48 |
| 63-90665 | 4/1988 | Japan . | |

*Primary Examiner*—Allan D. Herrmann
*Assistant Examiner*—Julie Krolikowski
*Attorney, Agent, or Firm*—Sughrue, Mion, Zinn, Macpeak & Seas

[57] ABSTRACT

An engine starter where a pinion, which is engaged or disengaged with a ring gear of the engine to be started, is formed as an integral part of a drive shaft at an end of the drive shaft which is movable in the axial direction thereof while being rotated by an electric motor. The engine starter has no restriction of the root thickness of the pinion or the number of teeth of the pinion, and has a large gear ratio to the ring gear.

9 Claims, 2 Drawing Sheets

ENGINE STARTER

This is a continuation of application Ser. No. 07/488,830 filed Mar. 6, 1990, now abandoned.

BACKGROUND OF THE INVENTION

1. Field of the Invention

The present invention relates to an engine starter which is used in starting automotive engines, particularly to an engine starter equipped with a drive shaft which rotates upon receipt of driving force of an electric motor and, moves in the axial direction thereof.

2. Description of Related Art

There have been engine starters equipped with drive shafts which move in the axial direction thereof while rotating due to the driving force of an electric motor, an example of which being that laid open in the Patent Application Laid-Open No. 63-90665. In this and other engine starters of the prior art, a pinion which is engaged or disengaged with a ring gear of the engine to be started is fitted, by means of a straight spline or the like, on the periphery of the front end of the drive shaft which moves axially while rotating. Also installed at the front end of the drive shaft which protrudes beyond the end face of the pinion is a stopper which prevents the pinion from dropping off.

The engine starter laid open in the publication mentioned above is a coaxial type engine starter, and is equipped with an electromagnetic switch which switches on the power to the electric motor disposed at the rear of the electric motor. Therefore, although the entire configuration is a thin cylinder and the construction is simple, its total length is greater than that of a 2-axis type engine starter.

In order to make effective use of the space in the engine room of an automobile or to reduce the weight of an automobile, automotive parts are required to become smaller in size. Engine starters, either coaxial or 2-axis type, are strongly required to become smaller, particularly in length.

SUMMARY OF THE INVENTION

The engine starter of the present invention is made in such a constitution that a drive shaft is rotated by an electric motor, is movable in the axial direction thereof and is formed with a pinion at an end thereof which is engaged or disengaged with a ring gear of an engine to be started.

The driving force of the electric motor is transmitted to the drive shaft, thereupon the pinion rotates. The drive shaft is thrusted forward so that the pinion comes in mesh with the ring gear of the engine. Because the pinion is incorporated into the drive shaft, the number of teeth of the pinion is not limited by the root thickness of the pinion or the strength of the drive shaft.

One object of the present invention is to provide an engine starter where the ratio of the pinion gear to the ring gear can be increased because the number of pinion gear teeth is not limited.

Another object of the present invention is to provide an engine starter where the electric motor is made compact and the total length is reduced.

Further another object of the present invention is to provide an engine starter where a stopper which prevents the pinion from dropping off is not needed.

The above and further objects and features of the invention will more fully be apparent from the following detailed description when taken with the accompanying drawings.

DESCRIPTION OF THE PREFERRED EMBODIMENTS

Figure 1:
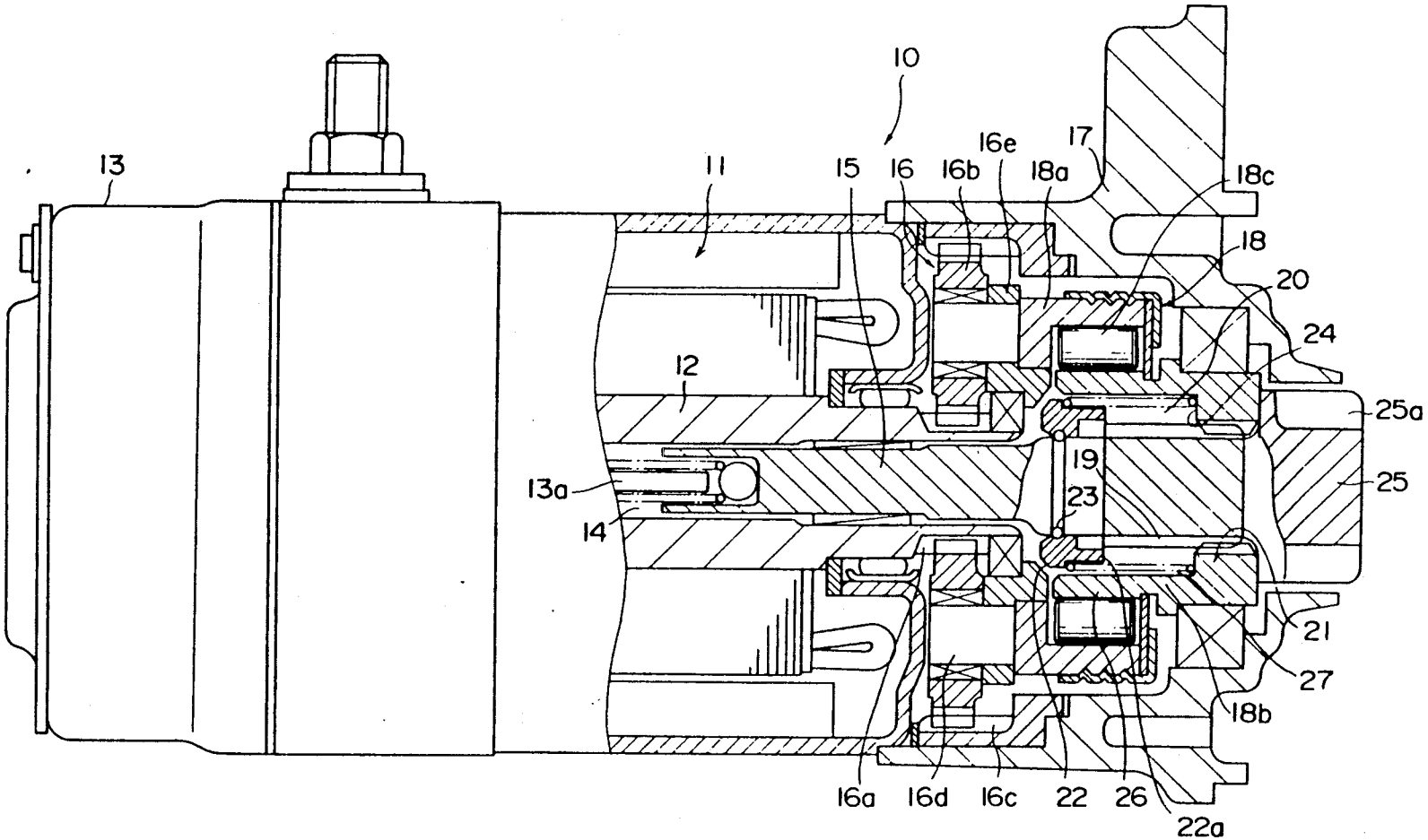
FIG. 1 is a partial cutaway drawing illustrative of an embodiment of the engine starter of the present invention.

FIG. 1 shows the engine starter 10 of an embodiment of the present invention. The engine starter of this embodiment is of a coaxial type.

In this drawing, 11 is a DC electric motor which has an armature rotary shaft 12 of a cylindrical shape. Disposed at the rear of the electric motor 11 is an electromagnetic switch 13 composed of an electromagnetic solenoid. The electromagnetic switch 13 has a plunger rod 13*a* which passes through an internal passage 14 of the armature rotary shaft 12. At the front of the armature rotary shaft 12, a drive shaft 15 is disposed coaxially therewith. The rear end of the drive shaft 15 is inserted into the internal passage 14. The rear end face of the drive shaft 15 and the front end face of the plunger rod 13*a* face oppositely to each other. When the electromagnetic switch 13 is closed, the plunger rod 13*a* is thrusted forward so that the front end face of the plunger rod 13*a* comes into contact with the rear end face of the drive shaft 15, thereby thrusting the drive shaft 15 forward.

Connected to the periphery of the front end of the armature rotary shaft 12 is a sun gear 16*a*. The sun gear 16*a* is in mesh with a plurality of planetary gears 16*b*. These planetary gears 16*b* mesh with an internal gear 16*c* which is provided on the internal surface of a frame 17. The planetary gears 16*b* are supported by a shaft 16*d* onto a carrier 16*e*. A planetary gear mechanism 16 which consists of the sun gear 16*a*, the planetary gears 16*b*, the internal gear 16*c*, the shaft 16*d* and the carrier 16*e* as described above reduces the revolution speed of the armature rotary shaft 12.

Formed on the circumference of the intermediate section of the drive shaft 15 is a helical spline 19 which is coupled through spline linkage to a spline-shaped section 21 of a clutch inner 18*b*. A pinion 25 which is engaged or disengaged with a ring gear (not shown in the drawings) of an engine to be started is formed at the front end of the drive shaft 15. The pinion 25 is incorporated into the drive shaft 15.

On the drive shaft 15, an overrun clutch mechanism 18 is movably fitted. The rear end of a clutch outer 18*a* of the clutch mechanism 18 is fitted to the front end of the carrier 16*e*. When an abnormal impact is applied to the clutch mechanism 18, the clutch outer 18*a* and the carrier 16*e* slip respective to each other to relieve the impact. At the front end (about one third of the total length) of the clutch inner 18*b*, a spline which meshes with the helical spline 19 is formed on the inner surface to form the spline-shaped section 21. Rotation of the armature rotary shaft 12 is transmitted via the planetary gear mechanism 16 to the clutch outer 18*a* of the clutch mechanism 18, then transmitted from rollers 18*c* via the clutch inner 18*b* and the helical spline 19 to the drive shaft 15. The rear end (about two thirds of the total length) of the clutch inner 18*b* is formed into an enlarged section 26, the inner diameter thereof is larger than the outer diameter of the helical spline 19. A space 20 is formed between the enlarged section 26 and the helical spline 19. A ring-shaped stopper 22 is disposed at the rear of the space 20. The stopper 22 is fixed on the drive shaft 15 by means of a ring 23. A spring 27 is laid down between the stopper 22 and the clutch inner 18*b*.

When the drive shaft 15 is thrusted by the plunger rod 13*a* to move forward, the stopper 22 moves forward together therewith in the space 20. When the drive shaft 15 has moved to such a position that the pinion 25 is engaged with the ring gear of the engine, the front end 22*a* of the stopper 22 comes in contact with the shoulder (rear end face of the spline-shaped section 21) 24 between the spline-shaped section 21 and the enlarged section 26. Therefore, forward movement of the drive shaft 15 stops when the pinion 25 is engaged with the ring gear of the engine. When the electromagnetic switch is opened, the plunger rod 13*a* is returned rearward so that the drive shaft 15 with the stopper 22 is returned to the former position by the elastic force of the spring 27.

According to the present invention, as described above, the pinion 25 and the drive shaft 15 are formed into an integral body. Consequently, the number of the teeth of the pinion 25 can be reduced without consideration to the bottom thickness (root thickness) of teeth 25*a* of the pinion 25 or to the strength of the drive shaft 15, to increase the gear ratio of the pinion 25 to the ring gear. In an engine starter of the prior art, because a separate pinion is fitted on the circumference of the front end of a drive shaft, the number of teeth of the pinion must be at least 8 in a module of 2.54 level, depending on the root thickness of the pinion or on the strength of the drive shaft. In the engine starter of the present invention, on the other hand, because the number of teeth of the pinion 25 can be freely set, an engine starter equipped with a pinion of 7 or less teeth can be made. Moreover, as the gear ratio of the pinion to the ring gear increases, the electric motor can be made compact and the total length of the engine starter can be reduced.

When the number of teeth of the pinion 25 is reduced, the inertia moment of the engine starter 10 viewed from the engine side increases. However, because the stopper 22 is disposed inside the clutch inner 18*b*, the diameter of the clutch mechanism 18 increases thereby the clutch capacity increases in view of the contact stress among the clutch outer 18*a*, the rollers 18*c* and the clutch inner 18*b* to improve the durability, and therefore no problem arises.

Figure 2:
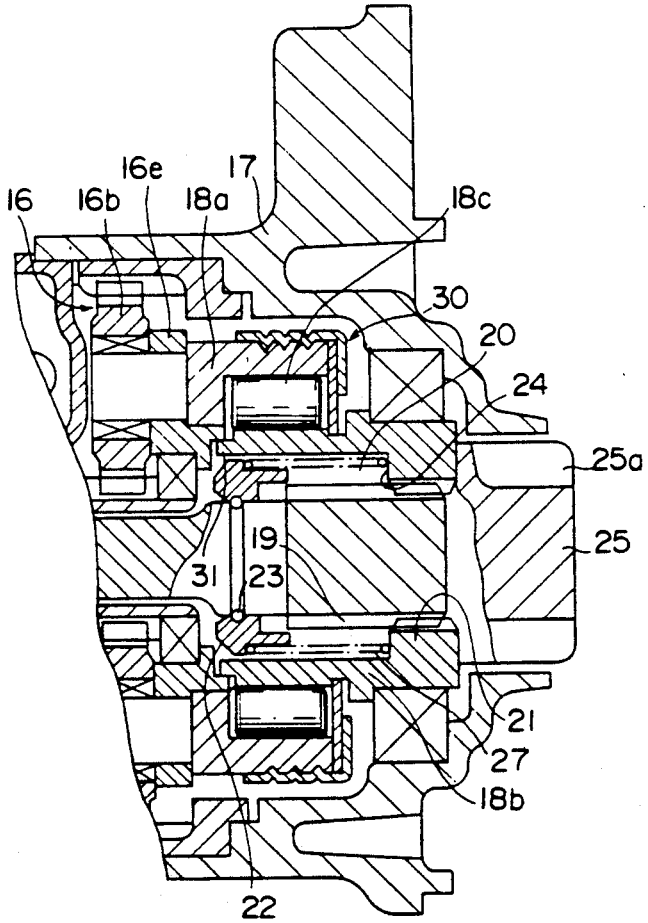
FIG. 2 is a partial cutaway drawing illustrative of another embodiment of the engine starter of the present invention.

FIG. 2 shows an engine starter 10 of another embodiment of the present invention. In FIG. 2, those which are assigned the same numbers as those in FIG. 1 are parts identical with or equivalent to those in FIG. 1. In this embodiment, a projecting section 31 which protrudes in the axial direction is formed at the rear end of a clutch inner 18*b* of an overrun clutch mechanism 30. This projecting section 31 is fitted with a minute clearance to the front end of a carrier 16*e* which is linked to the clutch outer 18*a* by fitting.

When the gear ratio of the pinion to the ring gear is increased by reducing the number of teeth of the pinion 25, the pinion 25 makes a larger number of revolutions in case the clutch mechanism 30 overruns, resulting in increased centrifugal force. In this situation, unbalanced weight in the direction of circumference in the clutch inner 18*b* causes eccentric rotation. In this embodiment, however, because the projecting section 31 of the clutch inner 18*b* is fitted to the inside of the front end of the carrier 16*e* with a minute clearance, such an eccentric rotation can be prevented.

The projecting section 31 may also be fitted to the rear end of the clutch outer 18*a* with a minute clearance, or may be received by a bearing. Otherwise a part of the carrier 16*e* may be extended and fitted to the inside of the clutch inner 18*b* with a minute clearance.

While an engine starter of such a constitution that the electromagnetic switch 13 is disposed at the rear is described in the previous embodiment, the present invention is by no means restricted to such a constitution, but can be applied to such a type as the drive shaft is thrusted by a shift lever to spring out forward.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalents of such metes and bounds thereof are therefore intended to be embraced by the claims.

What is claimed is:

1. An engine starter, comprising:

an electric motor, a drive shaft being rotatable by said electric motor, and being movable in the axial direction thereof, and a pinion adapted to be engaged or disengaged with a ring gear of an engine according to an axial position thereof, said pinion being integrally formed at an end of said drive shaft and having no more than seven teeth.

2. An engine starter of claim 1, further comprising a stopper which is fixed to said drive shaft and an overrun clutch mechanism equipped with a clutch inner, one end thereof being engaged with said drive shaft, said clutch inner having shoulder section disposed in the moving area of said stopper.

3. An engine starter of claim 2, wherein said stopper contacts said shoulder section when said pinion is engaged with said ring gear of the engine.

4. An engine starter of claim 2, wherein said end of the clutch inner is engaged with the drive shaft by spline engagement.

5. An engine starter of claim 1, wherein said electric motor has an armature rotary shaft.

6. An engine starter of claim 5, further comprising a gear mechanism which is connected to said armature rotary shaft and reduces the revolution speed of said armature rotary shaft, a stopper which is fixed to said drive shaft, and an overrun clutch mechanism equipped with a clutch inner, one end thereof being engaged with said drive shaft, said clutch inner having a shoulder section disposed in the moving area of said stopper.

7. An engine starter of claim 6, wherein the rotation of said armature rotary shaft is transmitted, via said gear mechanism and said overrun clutch mechanism, to said drive shaft.

8. An engine starter of claim 1, further comprising a plunger which thrusts said drive shaft so as to move said drive shaft in the axial direction thereof.

9. An engine starter of claim 8, further comprising an electromagnetic switch which controls the movement of said plunger and energizes said electric motor.

* * * * *